US011326776B1

(12) United States Patent
Cadima

(10) Patent No.: US 11,326,776 B1
(45) Date of Patent: May 10, 2022

(54) GAS BURNER WITH A COMPACT INJET AND FLOW SENSOR

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/095,061

(22) Filed: Nov. 11, 2020

(51) Int. Cl.

| | |
|---|---|
| ***F23D 14/06*** | (2006.01) |
| ***F23D 14/58*** | (2006.01) |
| ***F23K 5/00*** | (2006.01) |
| ***F24C 3/08*** | (2006.01) |

(52) U.S. Cl.
CPC ..... *F23D 14/06* (2013.01); *F23D 14/58* (2013.01); *F23D 2900/14062* (2013.01); *F23K 5/007* (2013.01); *F23K 2400/201* (2020.05); *F24C 3/085* (2013.01)

(58) Field of Classification Search
CPC ..... F23C 3/126; F23C 3/1482; F24N 1/00; F24N 1/005; F23D 2208/00; F23D 14/06; F23N 2037/10
USPC ..... 431/12, 354, 69–72, 288–297; 126/39 E, 126/39 R
See application file for complete search history.

(56) References Cited

U.S. PATENT DOCUMENTS

| | | | | |
|---|---|---|---|---|
| 8,845,326 | B2 * | 9/2014 | Shaffer | F23D 14/06 431/284 |
| 10,480,794 | B2 * | 11/2019 | Cadima | F23N 1/027 |
| 10,677,469 | B2 | 6/2020 | Paller | |
| 2005/0221243 | A1 * | 10/2005 | Najewicz | F23D 14/34 431/18 |
| 2020/0103105 | A1 | 4/2020 | Cadima | |

FOREIGN PATENT DOCUMENTS

| | | |
|---|---|---|
| CN | 106765334 A | 5/2017 |
| TM | W549860 U | 10/2017 |

OTHER PUBLICATIONS

Sivaranijith ("Advantages and Disadvantages of an Orifice and Venturi meter" https://automationforum.co/advantages-and-disadvantages-of-orifice-and-venturi-meter/. Nov. 15, 2018).*

* cited by examiner

*Primary Examiner* — Vivek K Shirsat
(74) *Attorney, Agent, or Firm* — Dority & Manning, P.A.

(57) ABSTRACT

A gas burner may include a burner body, a first gas orifice, a second gas orifice, a mixed outlet nozzle, an injet body, a gas supply line, a secondary gas line, and a flow sensor. The first gas orifice may be directed towards a plurality of naturally aspirated flame ports. The second gas orifice may be spaced apart from the first gas orifice. The mixed outlet nozzle may be downstream from the second gas orifice and directed towards a plurality of forced induction flame ports. The injet body may define an air passage and a mixing chamber downstream from the air passage. The gas supply line may be mounted on the injet body. The secondary gas line may extend in fluid parallel to the first gas orifice. The flow sensor may be positioned in fluid communication with the secondary gas line to detect a flow rate of gaseous fuel therethrough.

20 Claims, 9 Drawing Sheets

GAS BURNER WITH A COMPACT INJET AND FLOW SENSOR

FIELD OF THE INVENTION

The present subject matter relates generally to gas burners, such as forced induction gas burners.

BACKGROUND OF THE INVENTION

Conventional gas cooking appliances have one or more burners. A mixture of gaseous fuel and air combusts at the burners to generate heat for cooking. Known burners frequently include an orifice and Venturi mixing throat. A jet of gaseous fuel between the orifice and the Venturi mixing throat entrains air into the Venturi mixing throat with the jet of gaseous fuel. The air and gaseous fuel mix within the Venturi mixing throat, and the mixture of gaseous fuel and air is combusted at flame ports of the burners. Such burners are generally referred to as naturally aspirated gas burners.

Naturally aspirated gas burners can efficiently burn gaseous fuel. However, a power output of naturally aspirated gas burners is limited by the ability to entrain a suitable volume of air into the Venturi mixing throat with the jet of gaseous fuel. To provide increased entrainment of air, certain gas burners include a fan or pump that supplies pressurized air for mixing with the jet of gaseous fuel. Such gas burners are generally referred to as forced induction gas burners.

While offering increased power, known forced induction gas burners suffer from various drawbacks. For example, known forced induction gas burners are bulky and occupy large volumes within cooktop appliances. In addition, plumbing of the gas/air lines within known forced induction gas burners is complex and costly. Still further, it can be difficult to determine the volume or flow rate of gas to the forced induction burner. For instance, if multiple sets of apertures (e.g., coaxial flame rings) are provided, it can be difficult to detect or determine how much gas or fuel is directed to a particular aperture set or ring.

As a result, there is a need for an improved forced induction gas burner. In particular, it may be advantageous to provide a burner with one or more features for detecting gas or fuel to a forced induction burner aperture set or ring.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a gas burner is provided. The gas burner may include a burner body, a first gas orifice, a second gas orifice, a mixed outlet nozzle, an injet body, a gas supply line, a secondary gas line, and a flow sensor. The burner body may define a plurality of naturally aspirated flame ports and a plurality of forced induction flame ports. The first gas orifice may be directed towards the plurality of naturally aspirated flame ports. The second gas orifice may be spaced apart from the first gas orifice. The mixed outlet nozzle may be downstream from the second gas orifice and directed towards the plurality of forced induction flame ports. The injet body may define an air passage and a mixing chamber downstream from the air passage. The gas supply line may be mounted on the injet body upstream from the first gas orifice. The secondary gas line may extend in fluid parallel to the first gas orifice. The secondary gas line may be disposed upstream from the mixing chamber. The flow sensor may be positioned in fluid communication with the secondary gas line to detect a flow rate of gaseous fuel therethrough.

In another exemplary aspect of the present disclosure, a gas burner is provided. The gas burner may include a burner body, a first gas orifice, a second gas orifice, a mixed outlet nozzle, an injet body, a gas supply line, a secondary gas line, and a flow sensor. The burner body may define a plurality of naturally aspirated flame ports and a plurality of forced induction flame ports. The first gas orifice may be directed towards the plurality of naturally aspirated flame ports. The second gas orifice may be spaced apart from the first gas orifice. The mixed outlet nozzle may be downstream from the second gas orifice and directed towards the plurality of forced induction flame ports. The injet body may define an air passage, a gas passage, and a mixing chamber downstream from the air passage. The gas passage may be configured for directing the flow of gaseous fuel through the injet body to the first gas orifice. The second gas orifice and the injet body may form an eductor mixer within a mixing chamber of the injet body. The gas supply line may be mounted on the injet body upstream from the first gas orifice. The secondary gas line may extend from the gas supply line to the injet body in fluid parallel to the first gas orifice. The secondary gas line may be disposed upstream from the mixing chamber. The flow sensor may be positioned in fluid communication with the secondary gas line to detect a flow rate of gaseous fuel therethrough.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
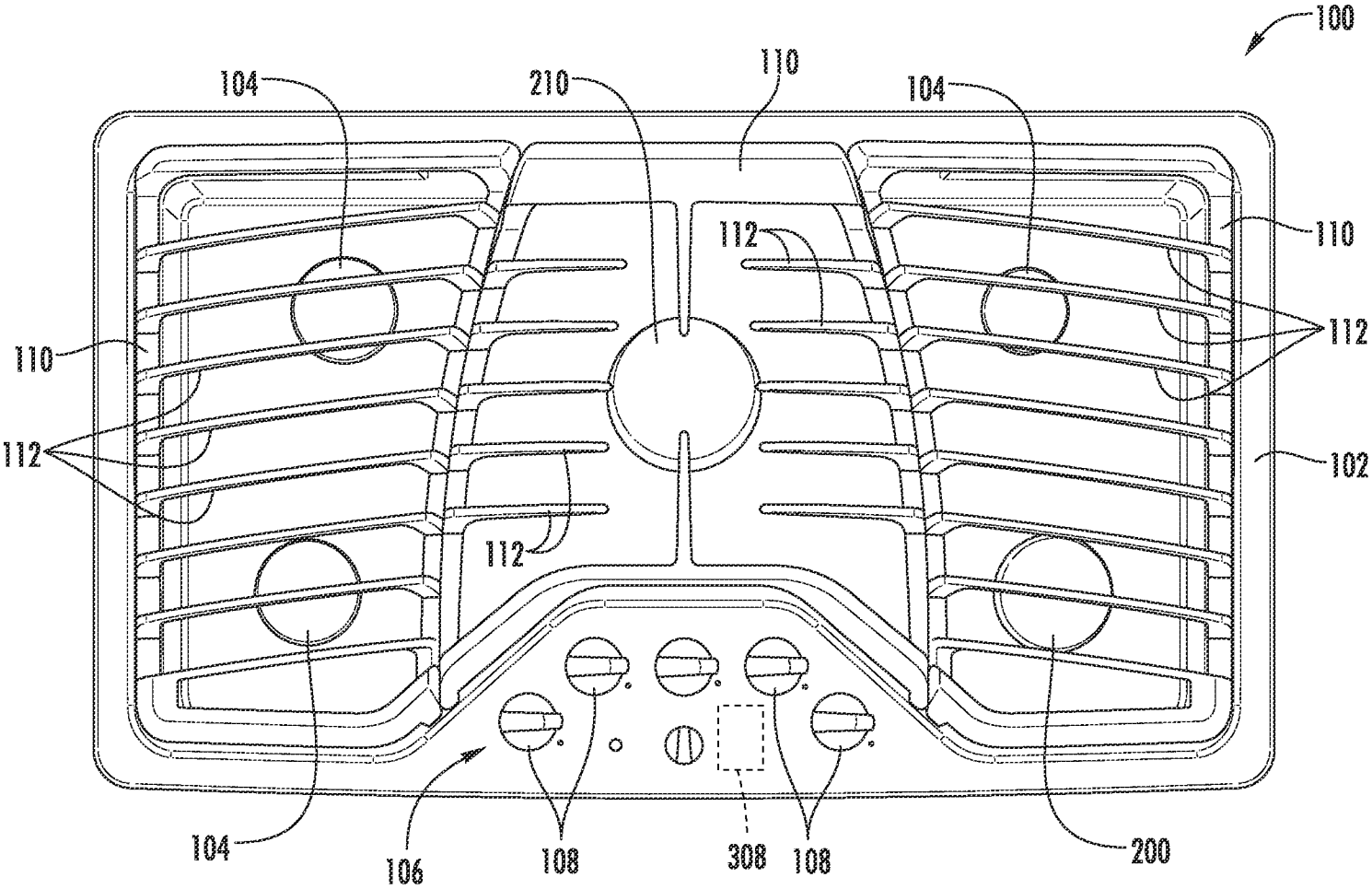
FIG. 1 provides a top, plan view of a cooktop appliance according to example embodiments of the present disclosure.
Figure 2:
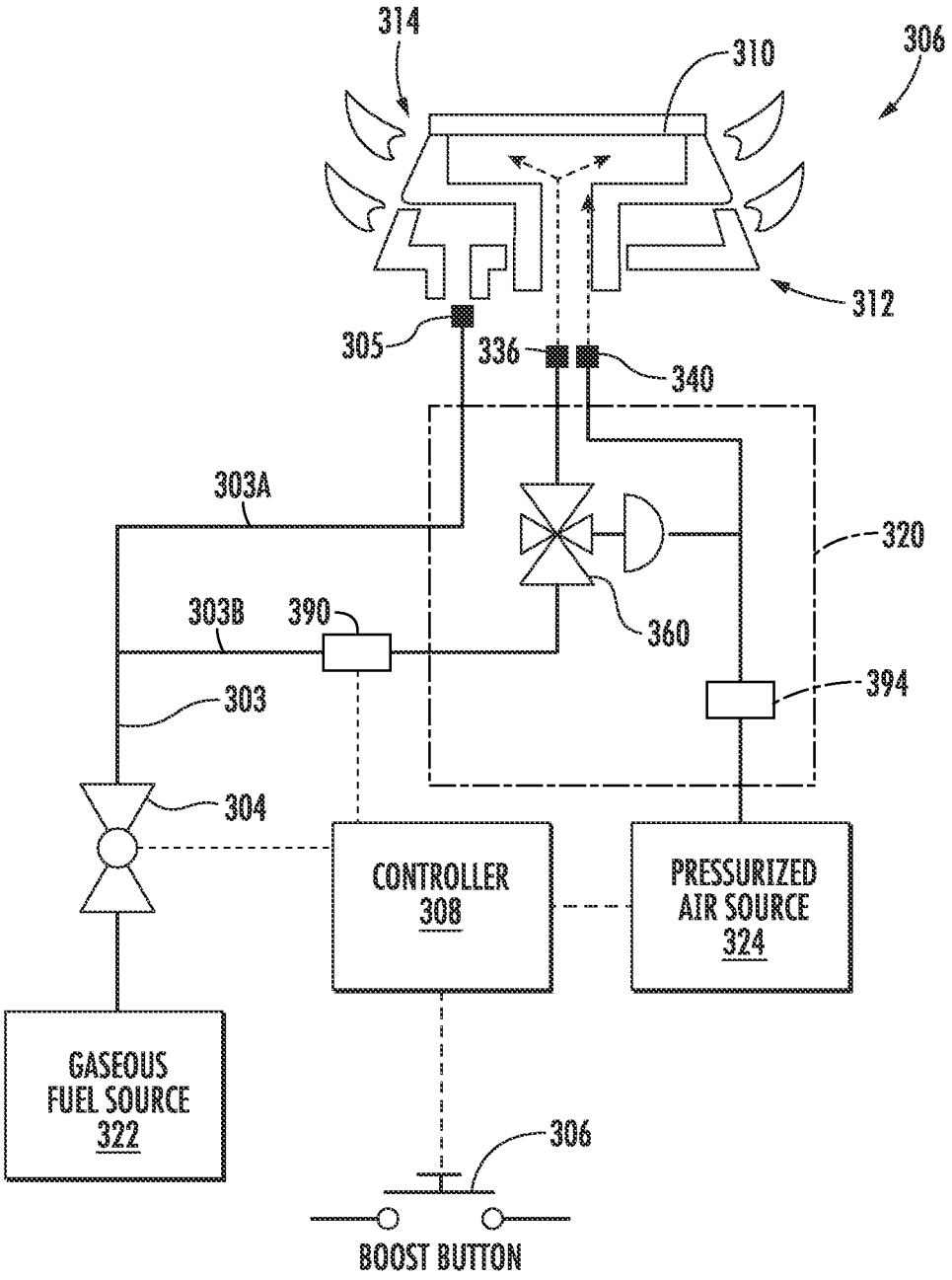
FIG. 2 is a schematic view of a gas burner according to exemplary embodiments of the present disclosure.
Figure 3:
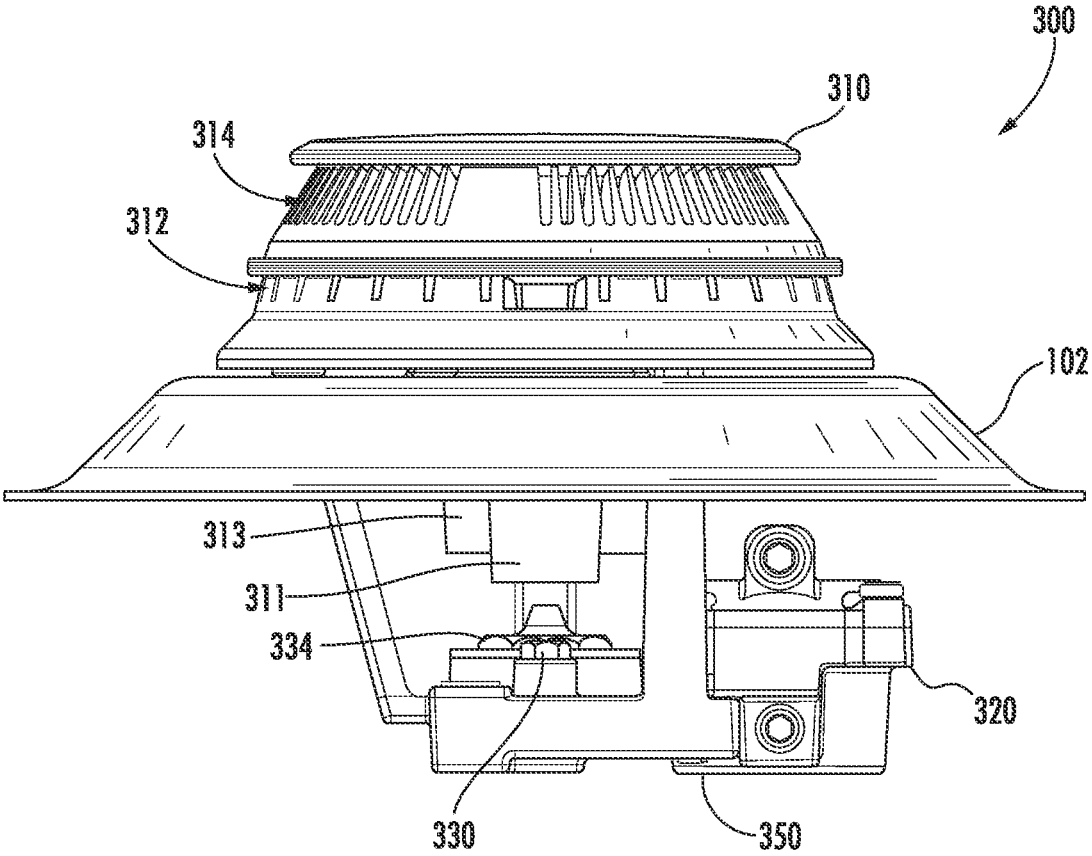
FIG. 3 is an elevation view of a gas burner according to exemplary embodiments of the present disclosure.
Figure 4:
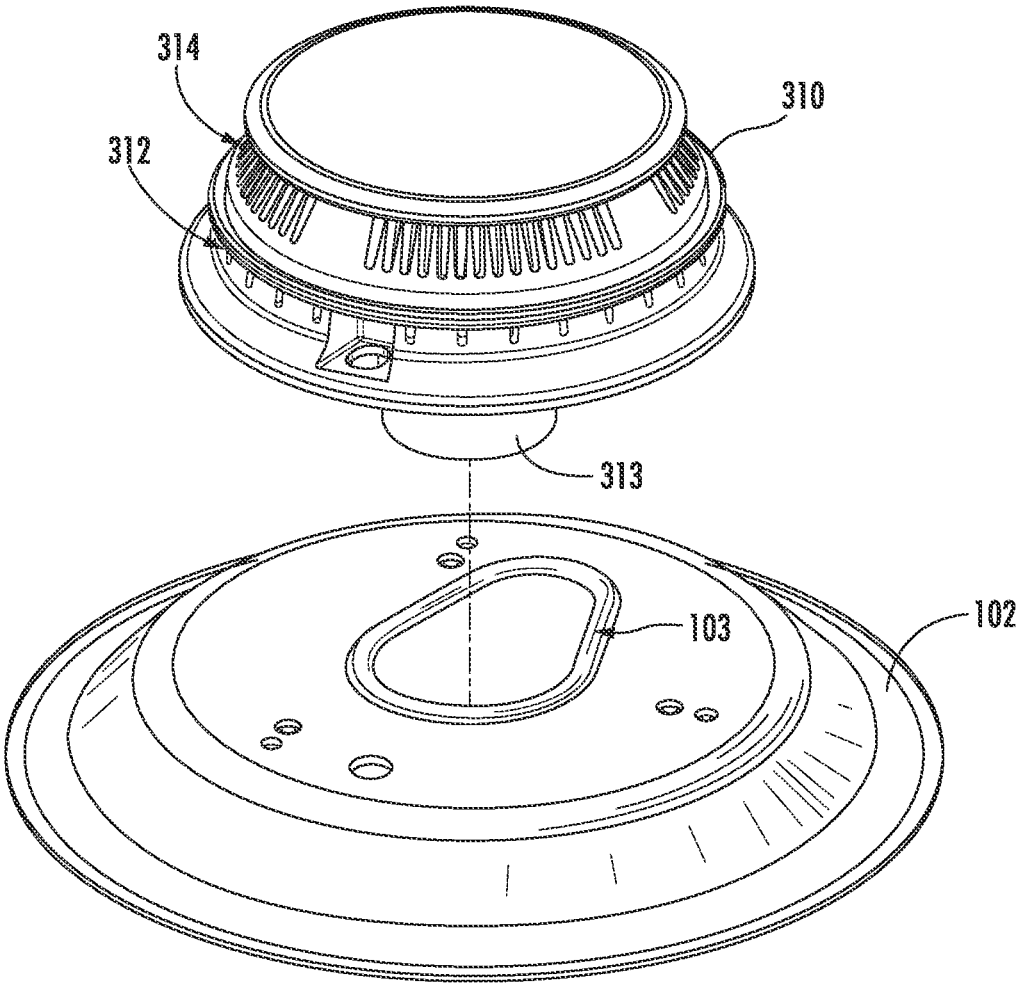
FIG. 4 is an exploded perspective view of a portion of a gas burner according to exemplary embodiments of the present disclosure.
Figure 5:
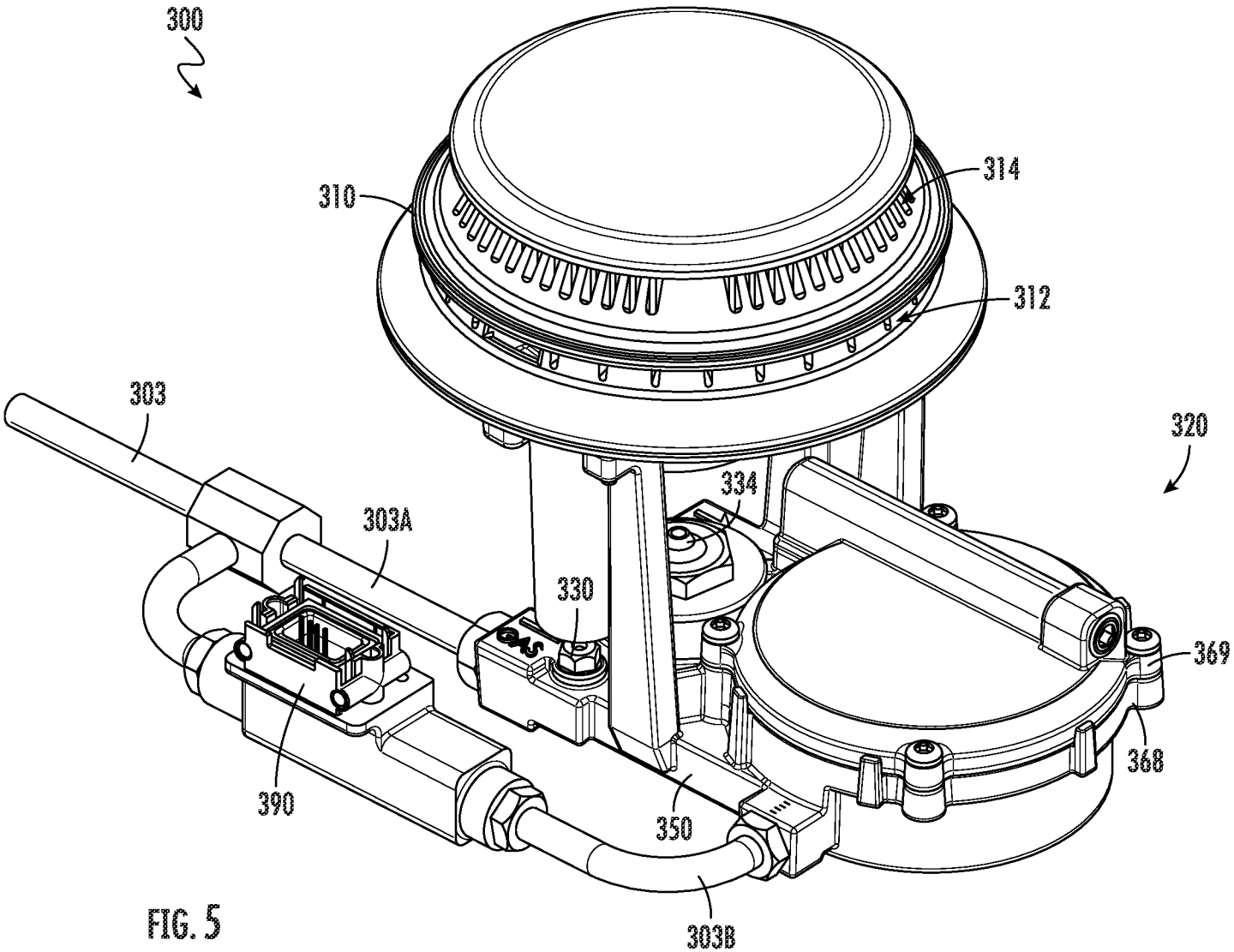
FIG. 5 is a perspective view of a gas burner according to exemplary embodiments of the present disclosure.
Figure 6:
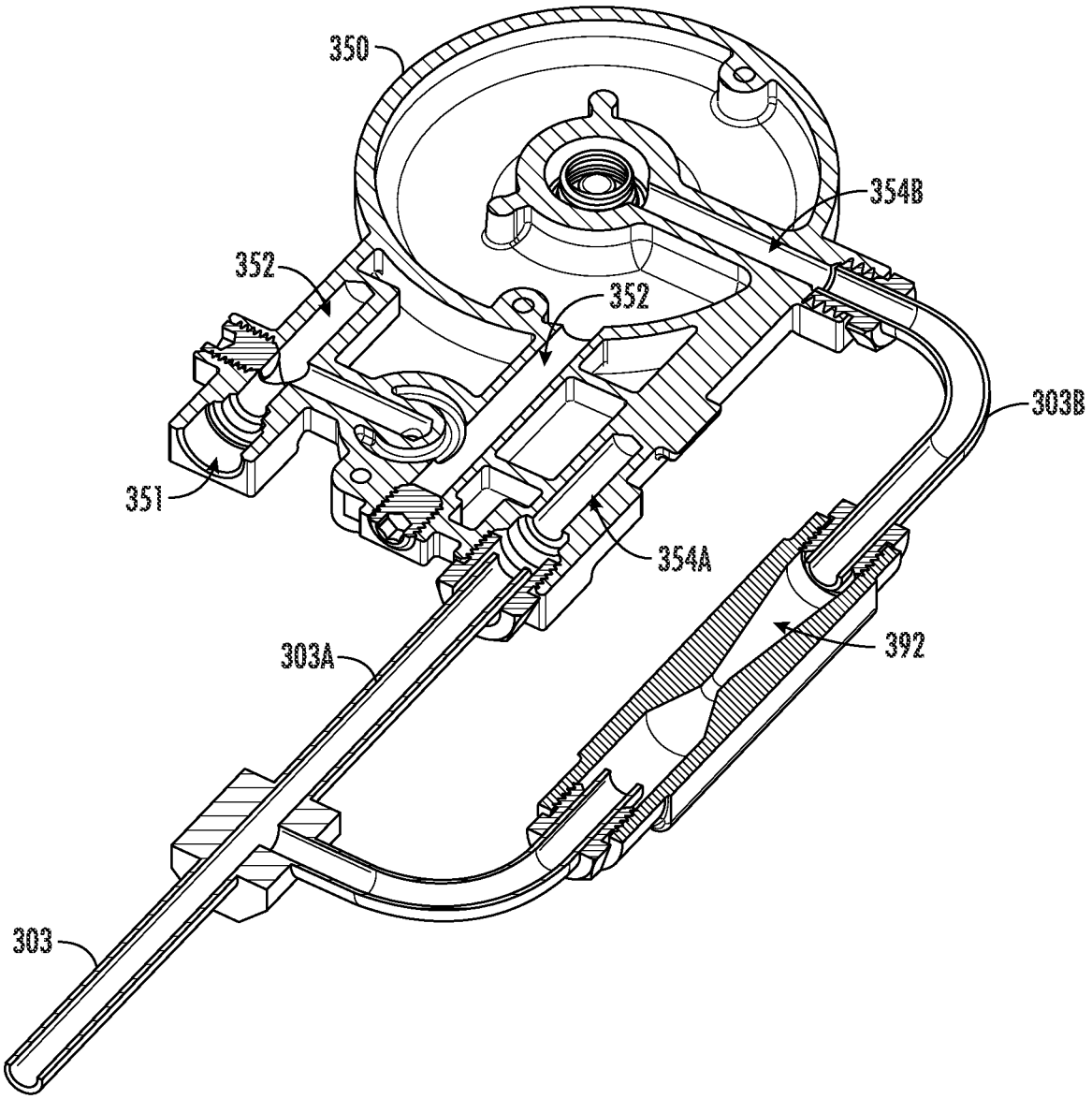
FIG. 6 is a perspective view of a bottom portion of a gas burner according to exemplary embodiments of the present disclosure.
Figure 7:
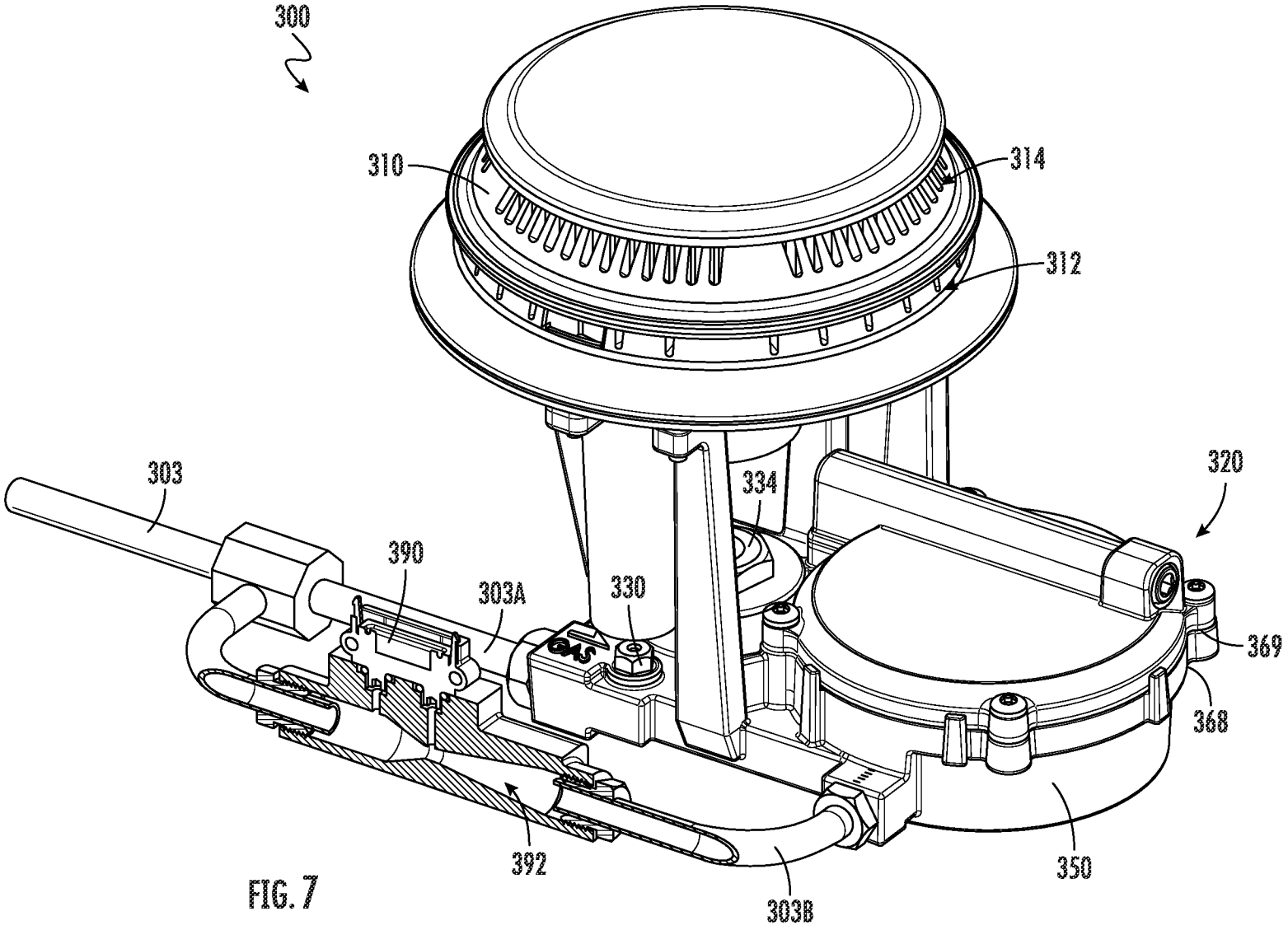
FIG. 7 is perspective view of a gas burner according to exemplary embodiments of the present disclosure, wherein a portion of a secondary line and flow sensor has been removed for clarity.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

FIG. 1 illustrates an example embodiment of a cooktop appliance 100 of the present disclosure. Cooktop appliance 100 may be, for example, fitted integrally with a surface of a kitchen counter or may be configured as a slide-in cooktop unit. Cooktop appliance 100 includes a top panel 102 that includes one or more heating sources, such as heating elements 104 for use in, for example, heating or cooking. In general, top panel 102 may be constructed of any suitably rigid and heat resistant material capable of supporting heating elements 104, cooking utensils, grates 110, or other components of cooktop appliance 100. By way of example, top panel 102 may be constructed of enameled steel, stainless steel, glass, ceramics, and combinations thereof.

According to the illustrated example embodiment, a user interface panel or control panel 106 is located within convenient reach of a user of cooktop appliance 100. In some embodiments, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it will be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

In some embodiments, a controller 308 may be configured to control one or more operations of cooktop appliance 100. For example, controller 308 may control at least one operation of cooktop appliance 100 that includes an internal heating element or cooktop heating element 104. Controller 308 may be in communication (via for example a suitable wired or wireless connection) with one or more of heating element(s) 104 and other suitable components of cooktop appliance 100.

By way of example, controller 308 may include one or more memory devices and one or more microprocessors, such as general or special purpose microprocessors operable to execute programming instructions or micro-control code associated with an operating cycle. The memory devices or memory may represent random access memory such as DRAM, or read only memory such as ROM or FLASH. In one embodiment, the processor executes programming instructions stored in memory. The memory may be a separate component from the processor or may be included onboard within the processor.

Controller 308 may be positioned in a variety of locations throughout cooktop appliance 100. As illustrated, controller 308 may be located within cooktop appliance 100 (e.g., beneath top panel 102). In some such embodiments, input/output ("I/O") signals may be routed between controller 308 and various operational components of cooktop appliance 100, such as heating element(s) 104, control knobs 108, display components, valves, fans, sensors, or other components as may be provided. For instance, signals may be directed along one or more wiring harnesses that may be routed through appliance 100. In some embodiments, controller 308 is in communication with the control panel 106 or 108 through which a user may select various operational features and modes and monitor progress of cooktop appliance 100.

In certain embodiments, controller 308 may include a power supply that is operably coupled to (i.e., in operable communication with) pressurized air source 324 for regulating its operation. For example, controller 308 may operate the power supply to drive pressurized air source 324 in a manner that accounts for a gas-air ratio, as described below. According to exemplary embodiments, the power supply may regulate operation of pressurized air source 324 by varying an input voltage or power. Alternatively, the power level of pressurized air source 324 may be adjusted by manipulating a pump control signal. In this regard, for example, the power supply may be a dedicated inverter power supply and the pump control signal may be any suitable digital control signal, such as a pulse width modulated signal having a duty cycle that is roughly proportional to the power level of pressurized air source 324. In this regard, for example, a fifty percent duty cycle may drive pressurized air source 324 at fifty percent of its rated speed, an eighty percent duty cycle may drive pressurized air source 324 at eighty percent of its rated speed, etc. It should be appreciated that other means for controlling the power level and speed of pressurized air source 324 are possible and within the scope of the present disclosure.

Cooktop appliance 100 is generally referred to as a "gas cooktop," and heating elements 104 are gas burners. For example, one or more of the gas burners in cooktop appliance may be a gas burner 300 described below. As illustrated, heating elements 104 are positioned on or within top panel 102 and have various sizes, as shown in FIG. 1, so as to provide for the receipt of cooking utensils (e.g., pots, pans, etc.) of various sizes and configurations and to provide different heat inputs for such cooking utensils. In addition, cooktop appliance 100 may include one or more grates 110 configured to support a cooking utensil, such as a pot, pan, etc. In general, grates 110 include a plurality of elongated members 112 (e.g., formed of cast metal, such as cast iron). The cooking utensil may be placed on the elongated members 112 of each grate 110 such that the cooking utensil rests on an upper surface of elongated members 112 during the cooking process. Heating elements 104 are positioned underneath the various grates 110 such that heating elements 104 provide thermal energy to cooking utensils above top panel 102 by combustion of fuel below the cooking utensils.

Turning now to FIGS. 2 through 9, a gas burner 300 according to example embodiments of the present disclosure is described. Gas burner 300 may be used in cooktop appliance 100 (e.g., as one of heating elements 104). Thus, gas burner 300 is described in greater detail below in the context of cooktop appliance 100. However, it will be understood that gas burner 300 may be used in or with any other suitable cooktop appliance in alternative example embodiments.

Gas burner 300 includes a burner body 310. Burner body 310 defines a plurality of naturally aspirated flame ports 312 and a plurality of forced induction flame ports 314. Naturally aspirated flame ports 312 may be distributed in a ring on burner body 310. Similarly, forced induction flame ports 314 may be distributed in a ring on burner body 310. Burner body 310 may also be stacked (e.g., such that forced induction flame ports 314 are positioned above naturally aspirated flame ports 312 on burner body 310). Thus, for example, the ring of forced induction flame ports 314 may be positioned above the ring of naturally aspirated flame ports 312 on burner body 310.

Naturally aspirated flame ports 312 may receive gaseous fuel from a gaseous fuel source 322, such as a natural gas line or propane line, when a user actuates one of control knobs 108 to adjust a control valve 304. Thus, for example, a gas supply line 303 for naturally aspirated flame ports 312 may extend from gaseous fuel source 322 and downstream therefrom in fluid communication with an upstream orifice 305 for naturally aspirated flame ports 312. As shown, a control valve 304 may be coupled to supply line 303 (e.g., upstream from a primary branch 303A and secondary gas line 303B) to selectively control the flow of gaseous fuel to burner body 310. For instance, control valve 304 may be in operable communication (e.g., wired, electrical, or mechanical communication) with a knob 108 or controller 308 and configured to selectively move (e.g., open/close) based on the position of a corresponding knob 108.

In certain embodiments, supply line 303 is split to provide a first branch (e.g., a primary branch 303A) and a second branch (e.g., a second gas line 303B) at a junction (e.g., via a plumbing tee, wye, or any other suitable splitting device). In general, primary branch 303A extends from the junction to an orifice for primary flame ports 312. Similarly, secondary gas line 303B extends from the junction to an orifice for forced induction flame ports 314.

Forced induction flame ports 314 may be plumbed in fluid parallel to naturally aspirated flame ports 312 in gas burner 300. In particular, a secondary gas line 303B may extend from the gas supply line 303 in fluid parallel to the primary branch 303A and orifice 305. As shown, the secondary gas line 303B may be downstream from the control valve 304. Thus, forced induction flame ports 314 may be capable of receiving gaseous fuel from gaseous fuel source 322 when the user actuates one of control knobs 108 to adjust control valve 304. Gas burner 300 also includes features for supplying air from a pressurized air source 324. Thus, forced induction flame ports 314 may operate with a higher flow rate of gaseous fuel or air compared to naturally aspirated flame ports 312.

In some embodiments, pressurized air source 324 is configured to supply a variable amount or flow rate (e.g., volumetric flow rate) of air to flame ports 314. For instance, pressurized air source 324 may be provided as or include an air pump (e.g., bellows-style air pump). Additionally or alternatively, pressurized air source 324 may include a fan, such as an axial or centrifugal fan, or any other device suitable for urging a flow of combustion air, such as an air compressor or a centralized compressed air system. Moreover, pressurized air source 324 may be configured for supplying the flow of combustion air at any suitable gage pressure, such as a half to one psig.

Optionally, forced induction flame ports 314 may be activated by pressing a boost burner button 306 on control panel 106. In response to a user actuating boost burner button 306, pressurized air source 324 may be activated (e.g., with a timer control or controller 308). Gas burner 300 also includes features for blocking the flow of gaseous fuel to forced induction flame ports 314 unless pressurized air source 324 is activated or pressurized air is suppled to forced induction flame ports 314, as discussed in greater detail below.

Gas burner 300 also includes an injet assembly 320. Injet assembly 320 may be positioned below top panel 102 (e.g., below an opening 103 of top panel 102). Conversely, burner body 310 may be positioned on top panel 102 (e.g., over opening 103 of top panel 102). Thus, burner body 310 may cover opening 103 of top panel 102 when burner body 310 is positioned on top panel 102. When burner body 310 is removed from top panel 102, injet assembly 320 below top panel 102 is accessible through opening 103. Thus, for example, a fuel orifice(s) of gas burner 300 on injet assembly 320 may be accessed by removing burner body 310 from top panel 102, and an installer may reach through opening 103 (e.g., with a wrench or other suitable tool) to change out the fuel orifice(s) of gas burner 300.

Injet assembly 320 is configured for directing a flow of gaseous fuel to naturally aspirated flame ports 312 of burner body 310. Thus, injet assembly 320 may be coupled to gaseous fuel source 322. During operation of gas burner 300, gaseous fuel from gaseous fuel source 322 may flow from injet assembly 320 into a vertical Venturi mixing tube 311. In particular, injet assembly 320 includes a first gas orifice 330 that is in fluid communication with a first gas passage 354A. A jet of gaseous fuel from gaseous fuel source 322 may exit injet assembly 320 at first gas orifice 330 and flow towards vertical Venturi mixing tube 311. Between first gas orifice 330 and vertical Venturi mixing tube 311, the jet of gaseous fuel from first gas orifice 330 may entrain air into vertical Venturi mixing tube 311. Air and gaseous fuel may mix within vertical Venturi mixing tube 311 prior to flowing to naturally aspirated flame ports 312 where the mixture of air and gaseous fuel may be combusted.

Injet assembly 320 is also configured for directing a flow of air and gaseous fuel to forced induction flame ports 314 of burner body 310. Thus, as discussed in greater detail below, injet assembly 320 may be coupled to pressurized air source 324 in addition to gaseous fuel source 322. During boosted operation of gas burner 300, a mixed flow of gaseous fuel from gaseous fuel source 322 and air from pressurized air source 324 may flow from injet assembly 320 into an inlet tube 313 prior to flowing to forced induction flame ports 314 where the mixture of gaseous fuel and air may be combusted at forced induction flame ports 314.

In addition to first gas orifice 330, injet assembly 320 also includes a second gas orifice 332, a mixed outlet nozzle 334, and an injet body 350. Injet body 350 defines an air passage 352 and a second gas passage 354B. Air passage 352 may be in fluid communication with pressurized air source 324. For example, a pipe or conduit may extend between pressurized air source 324 and injet body 350, and pressurized air from pressurized air source 324 may flow into air passage 352 via such pipe or conduit. Second gas passage 354B may be in fluid communication with gaseous fuel source 322 separate from (e.g., in fluid parallel with) first gas passage 354A. For example, a second gas line 303B extend between supply line 303 and injet body 350, and gaseous fuel from gaseous fuel source 322 may flow through a portion of supply line 303, through second gas line 303B, and into second gas passage 354B. In optional embodiments, injet body 350 defines a single inlet 351 for air passage 352 through which the pressurized air from pressurized air source 324 may flow into air passage 352, and injet body 350 defines a single inlet for second gas passage 354B through which the pressurized air from gaseous fuel source 322 may flow into second gas passage 354B.

First gas outlet orifice 330 is mounted to injet body 350 (e.g., at an outlet of first gas passage 354A). Thus, gaseous fuel from gaseous fuel source 322 may exit first gas passage 354A through first gas outlet orifice 330, and first gas passage 354A is configured for directing a flow of gaseous fuel through injet body 350 to first gas outlet orifice 330 (e.g., in fluid parallel to the second gas passage 354B). On injet body 350, first gas outlet orifice 330 is oriented for directing a flow of gaseous fuel towards vertical Venturi mixing tube 311 or naturally aspirated flame ports 312, as discussed above.

Second gas orifice 332 and injet body 350, for example, collectively, form an eductor mixer 380 within a mixing chamber 382 of injet body 350. Eductor mixer 380 is configured for mixing pressurized air from air passage 352 with gaseous fuel from second gas passage 354B in mixing chamber 382. In particular, an outlet 353 of air passage 352 is positioned at mixing chamber 382. A jet of pressurized air from pressurized air source 324 may flow from air passage 352 into mixing chamber 382 via outlet 353 of air passage 352. In some embodiments, second gas orifice 332 is positioned within injet body 350 between mixing chamber 382 and second gas passage 354B. Gaseous fuel from gaseous fuel source 322 may flow from second gas passage 354B into mixing chamber 382 via second gas orifice 332. As an example, second gas orifice 332 may be a plate that defines a plurality of through holes, and the gaseous fuel in second gas passage 354B may flow through such holes into mixing chamber 382.

The jet of pressurized air flowing into mixing chamber 382 via outlet 353 of air passage 352 may draw and entrain gaseous fuel flowing into mixing chamber 382 via second gas orifice 332. In addition, as the gaseous fuel is entrained into the air, a mixture of air and gaseous fuel is formed within mixing chamber 382. From mixing chamber 382, the mixture of air and gaseous fuel may flow from mixing chamber 382 via mixed outlet nozzle 334. In particular, mixed outlet nozzle 334 is mounted to injet body 350 at mixing chamber 382, and mixed outlet nozzle 334 is oriented on injet body 350 for directing the mixed flow of air and gaseous fuel from mixing chamber 382 into inlet tube 313 or towards forced induction flame ports 314, as discussed above.

Burner body 310 may be positioned over injet body 350 (e.g., when burner body 310 is positioned on top panel 102). In addition, first gas orifice 330 may be oriented on injet body 350 such that first gas orifice 330 directs the flow of gaseous fuel upwardly towards vertical Venturi mixing tube 311 and naturally aspirated flame ports 312. Similarly, mixed outlet nozzle 334 may be oriented on injet body 350 such that mixed outlet nozzle 334 directs the mixed flow of air and gaseous fuel upwardly towards inlet tube 313 and forced induction flame ports 314.

First and second gas orifices 330, 332 may be removeable from injet body 350. First and second gas orifices 330, 332 may also be positioned on injet body 350 directly below burner body 310 (e.g., when burner body 310 is positioned on top panel 102). Thus, for example, first and second gas orifices 330, 332 may be accessed by removing burner body 310 from top panel 102, and an installer may reach through opening 103 (e.g., with a wrench or other suitable tool) to change out first and second gas orifices 330, 332.

In certain embodiments, injet assembly 320 includes a pneumatically actuated gas valve 360. Pneumatically actuated gas valve 360 may be positioned within injet body 350, and pneumatically actuated gas valve 360 is adjustable between a closed configuration and an open configuration. In the closed configuration, pneumatically actuated gas valve 360 blocks the flow of gaseous fuel through second gas passage 354B to second gas orifice 332, eductor mixer 380 or mixed outlet nozzle 334 (e.g., without blocking or restricting the flow of gaseous fuel through first gas passage 354A). Conversely, pneumatically actuated gas valve 360 permits the flow of gaseous fuel through second gas passage 354B to second gas orifice 332/eductor mixer 380 in the open configuration. Pneumatically actuated gas valve 360 is configured to adjust from the closed configuration to the open configuration in response to the flow of air through air passage 352 to outlet 353 of air passage 352. Thus, for example, pneumatically actuated gas valve 360 is in fluid communication with air passage 352 and opens in response to air passage 352 being pressurized by air from pressurized air source 324. As an example, pneumatically actuated gas valve 360 may be positioned on a branch of air passage 352 relative to outlet 353 of air passage 352.

It will be understood that first gas outlet orifice 330 may be in fluid communication with first gas passage 354A in both the open and closed configurations of pneumatically actuated gas valve 360. Specifically, first gas outlet orifice 330 may be positioned on first gas passage 354A downstream from supply line 303 and in fluid parallel to second gas passage 354B. Thus, pneumatically actuated gas valve 360 may regulate the flow of gas through second gas orifice 332 but not first gas outlet orifice 330.

Figure 8:
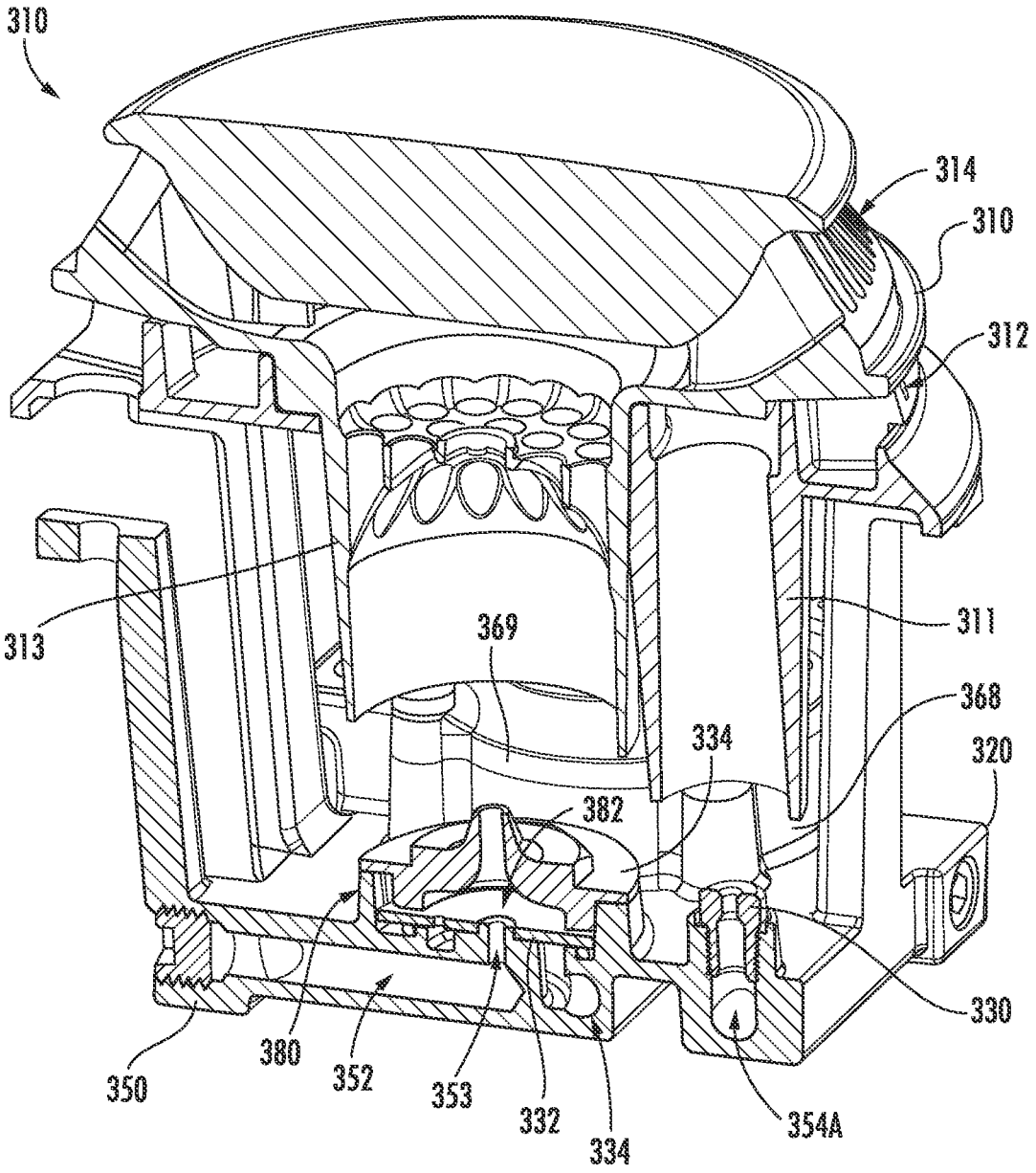
FIG. 8 is a sectional perspective view of a gas burner according to exemplary embodiments of the present disclosure.
Figure 9:
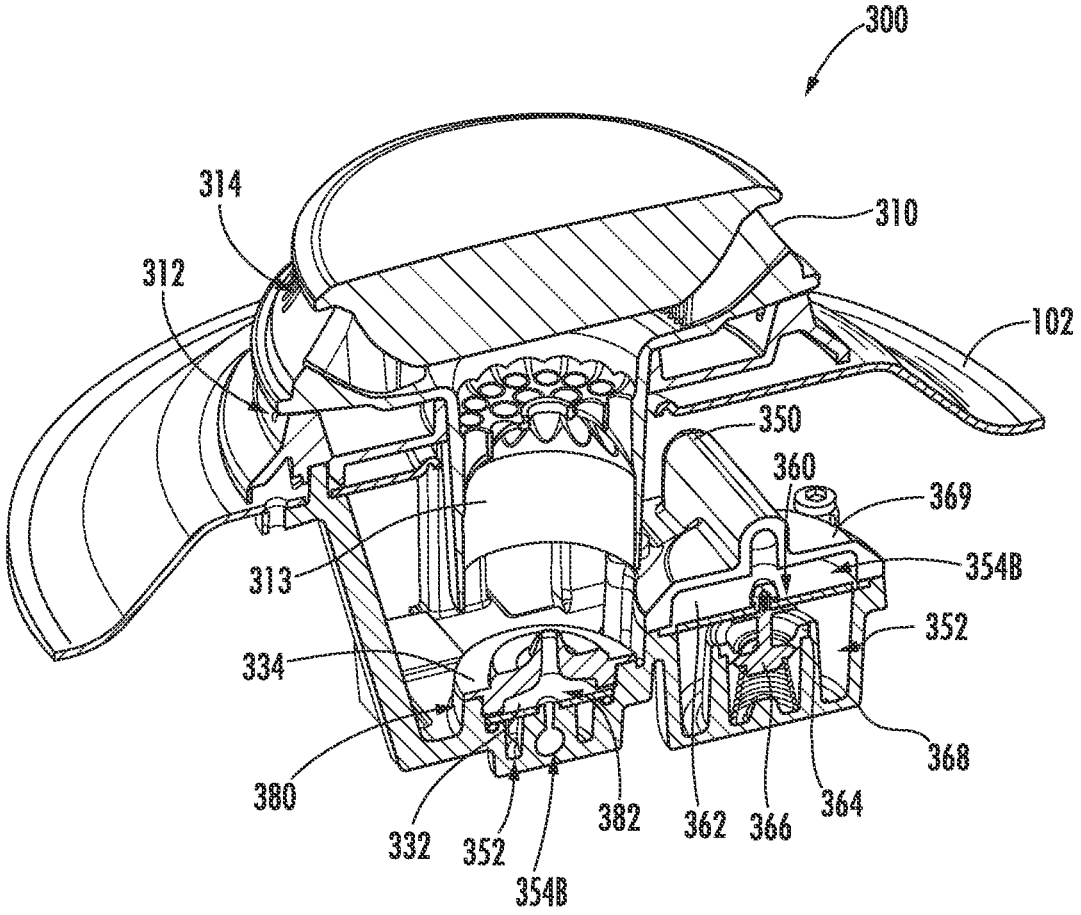
FIG. 9 is another sectional perspective view of a gas burner according to exemplary embodiments of the present disclosure.

As shown in FIGS. 8 and 9, pneumatically actuated gas valve 360 includes a diaphragm 362, a seal 364 and a plug 366. Diaphragm 362 is positioned between air passage 352 and second gas passage 354B within injet body 350. For example, diaphragm 362 may be circular and may be clamped between a first injet body half 368 and a second injet body half 369. In particular, first and second injet body halves 368, 369 may be fastened together with diaphragm 362 positioned between first and second injet body halves 368, 369.

Seal 364 is mounted to injet body 350 within second gas passage 354B. Plug 366 is mounted to diaphragm 362 (e.g., such that plug 366 travels with diaphragm 362 when diaphragm 362 deforms). Plug 366 is positioned against seal 364 when pneumatically actuated gas valve 360 is closed. A spring 370 may be coupled to plug 366. Spring 370 may urge plug 366 towards seal 364. Thus, pneumatically actuated gas valve 360 may be normally closed.

When air passage 352 is pressurized by air from pressurized air source 324, diaphragm 362 may deform due to the pressure of air in air passage 352 increasing, and plug 366 may shift away from seal 364 as diaphragm 362 deforms. In such a manner, diaphragm 362, seal 364 and plug 366 may cooperate to open pneumatically actuated gas valve 360 in response to air passage 352 being pressurized by air from pressurized air source 324. Conversely, diaphragm 362 may return to an undeformed state when air passage 352 is no longer pressurized by air from pressurized air source 324, and plug 366 may shift against seal 364. In such a manner, diaphragm 362, seal 364 and plug 366 may cooperate to close pneumatically actuated gas valve 360 in response to air passage 352 no longer being pressurized by air from pressurized air source 324.

In certain embodiments, a flow sensor 390 is positioned in fluid communication with the secondary gas line 303B to detect a flow rate of gas therethrough (e.g., upstream from second gas passage 354B or pneumatically actuated gas valve 360). For instance, flow sensor 390 may be mounted on secondary gas line 303B between the junction with supply line 303 and injet body 350. Generally, flow sensor 390 is coupled to controller 308 and configured to detect a flow rate of gaseous fuel through secondary gas line 303B and may be provided as a suitable sensor therefor. In some embodiments, flow sensor 390 is configured to detect a pressure difference between discrete points (e.g., an upstream point and a downstream point) on secondary gas line 303B. As shown, a Venturi passage 392 may be defined on the secondary gas line 303B between the gas supply line 303 and the injet body 350. The upstream point of the flow sensor 390 may be defined upstream from the throat of Venturi passage 392 while the downstream point of the flow sensor 390 is defined at or proximal to the throat of Venturi passage 392.

Advantageously, flow sensor 390 is held apart from injet body 350, at a distance from the heat created when the flame ports 312 or 314 are active.

In exemplary embodiments, it may also be desirable to measure a pressure of the flow of air downstream of pressurized air source 324. In this regard, for example, an airflow sensor 394 may be positioned in fluid communication with an air supply conduit upstream from air passage 352. For instance, airflow sensor 394 may be mounted on or within an air conduit between pressurized air source 324 and air passage 352 to detect a flow rate of air therethrough. Generally, airflow sensor 394 is coupled to controller 308 and configured to detect a flow rate of air to air passage 352 and may be provided as a suitable sensor therefor. In some embodiments, airflow sensor 394 is configured to detect a pressure difference between discrete points (e.g., an upstream point and a downstream point) on the air conduit, similar to flow sensor 290.

According to exemplary embodiments, airflow sensor 394 may be generally configured for monitoring the output pressure or flow of pressurized air source 324 and controller 308 may adjust the operation of gas burner 300 accordingly.

In certain embodiments, controller 308 is configured to initiate or otherwise direct a boost operation (e.g., in response to user engagement with the boost button 306 or otherwise selecting a boost operation). The boost operation may include receiving a flow signal (e.g., first flow signal, such as a voltage) from the flow sensor 390. The first flow signal generally corresponds to the flow rate (e.g., volumetric flow rate) of gaseous fuel through second gas line 303B to second gas passage 354B. Additionally or alternatively, the controller 308 may receive an airflow signal (e.g., first airflow signal) from the airflow sensor 394, which corresponds to the pressure or flow rate of air to the air passage 352. Based on the first flow signal or airflow signal, controller 308 may determine an initial fuel-air ratio at the mixed outlet nozzle 334.

Subsequently, the boost operation can include comparing the initial fuel-air ratio to a predetermined baseline ratio (e.g., programmed within controller 308). Optionally, the predetermined baseline ratio may correspond to a position of a corresponding knob 108 or valve 304. If the initial fuel-air ratio does not meet the predetermined baseline ratio (e.g., the absolute value of the difference between the initial fuel-air ratio and the predetermined baseline ratio exceeds a preset limit, or the initial fuel-air ratio is not within a preset percentage of the predetermined baseline ratio), the controller 308 may direct an adjustment to the flow of gaseous fuel (e.g., at valve 304) or air (e.g., at pressurized air source 324). As an example, in response to a comparison wherein the initial fuel-air ratio does not meet the predetermined baseline ratio, the controller 308 may adjust a flow rate of air through the air passage 352. In particular, the adjustment may be made according to the comparison. If the initial fuel-air ratio is less than the predetermined baseline ratio, the flow rate of air from the pressurized air source 324 may be decreased. If the initial fuel-air ratio is greater than the predetermined baseline ratio, the flow rate of air from the pressurized air source 324 may be increased.

After the adjustment is made, the controller 308 may again detect a flow rate of gaseous fuel (e.g., at the flow sensor 390) or air (e.g., at the airflow sensor 394). For instance, the controller 308 may receive a second or subsequent flow signal from the flow sensor 390. Additionally or alternatively, the controller 308 may receive a second or subsequent airflow signal from the airflow sensor 394. Based on the second flow signal or airflow signal, the controller 308 may determine an adjusted fuel-air ratio. Optionally, further adjustments may be made to the flow of air or gaseous fuel according to the comparison, similar to those described above. Additionally or alternatively, particular conditions may cause the controller 308 to halt the flow of air or gaseous fuel to the burner body 310 (e.g., by halting the flow from pressurized air source 324 to close gas valve 360) or otherwise end the boost operation. For instance, in response to determining that the adjusted fuel-air ratio is less than the predetermined baseline ratio, the operation may include halting air flow or gas flow (i.e., the flow of gaseous fuel) to at least a portion of the burner body 310. Advantageously, wasteful or undesirable operation of the burner 300 may be prevented.

As may be seen from the above, gas burner 300 includes a compact injet assembly 320. Thus, an installation footprint or required plumbing for gas burner 300 within cooktop appliance 100 may be reduced compared to known gas burners. Moreover, the flow of gaseous fuel specific to a set of induced flame ports 314 may be effectively detected without requiring a set of sensors or assemblies that have to endure a relatively high-heat environment.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner, comprising:

a burner body defining a plurality of naturally aspirated flame ports and a plurality of forced induction flame ports;

a first gas orifice directed towards the plurality of naturally aspirated flame ports;

a second gas orifice spaced apart from the first gas orifice;

a mixed outlet nozzle downstream from the second gas orifice and directed towards the plurality of forced induction flame ports;

an injet body defining an air passage and a mixing chamber downstream from the air passage;

a gas supply line mounted on the injet body upstream from the first gas orifice;

a control valve coupled to the gas supply line to selectively control a gaseous fuel flow therethrough;

a secondary gas line extending in fluid parallel to the first gas orifice, the secondary gas line being disposed upstream from the mixing chamber; and a flow sensor positioned in fluid communication with the secondary gas line to detect a flow rate of gaseous fuel therethrough, wherein the gas supply line is split between a primary branch and the secondary gas line at a junction downstream from the control valve, and wherein gas flows through the junction at a set ratio.

2. The gas burner of claim 1, wherein the secondary gas line defines a Venturi passage between the gas supply line and the injet body.

3. The gas burner of claim 1, further comprising:

a controller in operable communication with the flow sensor, wherein the controller is configured to initiate a boost operation comprising receiving a first flow signal from the flow sensor, and determining an initial fuel-air ratio at the mixed outlet nozzle based on the first flow signal.

4. The gas burner of claim 3, wherein the boost operation further comprises comparing the initial fuel-air ratio to a predetermined baseline ratio, and adjusting a flow rate of air through the air passage according to the comparison of the initial fuel-air ratio to the predetermined baseline ratio.

5. The gas burner of claim 4, wherein the boost operation further comprises receiving a second flow signal from the flow sensor subsequent to the first flow signal, determining an adjusted fuel-air ratio at the mixed outlet nozzle based on the second flow signal, determining the adjusted fuel-air ratio is less than the baseline ratio, and halting a flow of air or gas to the burner body in response to determining the adjusted fuel-air ratio is less than the baseline ratio.

6. The gas burner of claim 1, wherein the injet body defines a gas passage downstream from the gas supply line, and wherein the gas burner further comprises:

a pneumatically actuated gas valve, the pneumatically actuated gas valve adjustable between a closed configuration and an open configuration, the pneumatically actuated gas valve blocking the flow of gaseous fuel through the gas passage in the closed configuration, the pneumatically actuated gas valve configured to adjust from the closed configuration to the open configuration in response to the flow of air through the air passage.

7. The gas burner of claim 6, wherein the pneumatically actuated gas valve is positioned within the injet body.

8. The gas burner of claim 7, wherein the injet body comprises an injet body base and an injet body cover, and wherein the diaphragm is clamped between the injet body base and the injet body cover.

9. The gas burner of claim 1, wherein the burner body is positioned over the injet body such that the first gas orifice is oriented for directing the flow of gaseous fuel upwardly towards the plurality of naturally aspirated flame ports and such that the mixed outlet nozzle is oriented for directing the mixed flow of air and gaseous fuel from the mixing chamber upwardly towards the plurality of forced induction flame ports.

10. A gas burner, comprising:

a burner body defining a plurality of naturally aspirated flame ports and a plurality of forced induction flame ports;

a first gas orifice directed towards the plurality of naturally aspirated flame ports;

a second gas orifice spaced apart from the first gas orifice;

a mixed outlet nozzle downstream from the second gas orifice and directed towards the plurality of forced induction flame ports;

an injet body defining an air passage, a gas passage, and a mixing chamber downstream from the air passage, the gas passage configured for directing the flow of gaseous fuel through the injet body to the first gas orifice, the second gas orifice and the injet body forming an eductor mixer within a mixing chamber of the injet body;

a gas supply line mounted on the injet body upstream from the first gas orifice;

a control valve coupled to the gas supply line to selectively control a gaseous fuel flow therethrough;

a secondary gas line extending from the gas supply line to the injet body in fluid parallel to the first gas orifice, the secondary gas line being disposed upstream from the mixing chamber; and a flow sensor mounted on the secondary gas line to detect a flow rate of gaseous fuel therethrough, wherein the gas supply line is split between a primary branch and the secondary gas line at a junction downstream from the control valve, and wherein gas flows through the junction at a set ratio.

11. The gas burner of claim 10, wherein the secondary gas line defines a Venturi passage between the gas supply line and the injet body.

12. The gas burner of claim 10, further comprising:

a controller in operable communication with the flow sensor, wherein the controller is configured to initiate a boost operation comprising receiving a first flow signal from the flow sensor, and determining an initial fuel-air ratio at the mixed outlet nozzle based on the first flow signal.

13. The gas burner of claim 12, wherein the boost operation further comprises comparing the initial fuel-air ratio to a predetermined baseline ratio, and adjusting a flow rate of air through the air passage according to the comparison of the initial fuel-air ratio to the predetermined baseline ratio.

14. The gas burner of claim 13, wherein the boost operation further comprises receiving a second flow signal from the flow sensor subsequent to the first flow signal, determining an adjusted fuel-air ratio at the mixed outlet nozzle based on the second flow signal, determining the adjusted fuel-air ratio is less than the baseline ratio, and halting a flow of air or gas to the burner body in response to determining the adjusted fuel-air ratio is less than the baseline ratio.

15. The gas burner of claim 10, further comprising:

a pneumatically actuated gas valve, the pneumatically actuated gas valve adjustable between a closed configuration and an open configuration, the pneumatically actuated gas valve blocking the flow of gaseous fuel through the gas passage to the eductor mixer in the closed configuration, the pneumatically actuated gas valve configured to adjust from the closed configuration to the open configuration in response to the flow of air through the air passage.

16. The gas burner of claim 15, wherein the pneumatically actuated gas valve is positioned within the injet body.

17. The gas burner of claim 16, wherein the injet body comprises an injet body base and an injet body cover, and wherein the diaphragm is clamped between the injet body base and the injet body cover.

18. The gas burner of claim 10, wherein the burner body is positioned over the injet body such that the first gas orifice is oriented for directing the flow of gaseous fuel upwardly towards the plurality of naturally aspirated flame ports and such that the mixed outlet nozzle is oriented for directing the mixed flow of air and gaseous fuel from the mixing chamber upwardly towards the plurality of forced induction flame ports.

19. A gas burner, comprising:

a burner body defining a plurality of naturally aspirated flame ports and a plurality of forced induction flame ports;

a first gas orifice directed towards the plurality of naturally aspirated flame ports;

a second gas orifice spaced apart from the first gas orifice;

a mixed outlet nozzle downstream from the second gas orifice and directed towards the plurality of forced induction flame ports;

an injet body defining an air passage and a mixing chamber downstream from the air passage;

a gas supply line mounted on the injet body upstream from the first gas orifice;

a secondary gas line extending in fluid parallel to the first gas orifice, the secondary gas line being disposed upstream from the mixing chamber;

a flow sensor positioned in fluid communication with the secondary gas line to detect a flow rate of gaseous fuel therethrough; and a controller in operable communication with the flow sensor, wherein the controller is configured to initiate a boost operation comprising receiving a first flow signal from the flow sensor, determining an initial fuel-air ratio at the mixed outlet nozzle based on the first flow signal, comparing the initial fuel-air ratio to a predetermined baseline ratio, adjusting a flow rate of air through the air passage according to the comparison of the initial fuel-air ratio to the predetermined baseline ratio, receiving a second flow signal from the flow sensor subsequent to the first flow signal, determining an adjusted fuel-air ratio at the mixed outlet nozzle based on the second flow signal, determining the adjusted fuel-air ratio is less than the baseline ratio, and halting a flow of air or gas to the burner body in response to determining the adjusted fuel-air ratio is less than the baseline ratio.

20. The gas burner of claim 19, wherein the injet body defines a gas passage downstream from the gas supply line, and wherein the gas burner further comprises:

a pneumatically actuated gas valve, the pneumatically actuated gas valve adjustable between a closed configuration and an open configuration, the pneumatically actuated gas valve blocking the flow of gaseous fuel through the gas passage in the closed configuration, the pneumatically actuated gas valve configured to adjust from the closed configuration to the open configuration in response to the flow of air through the air passage.

* * * * *